United States Patent [19]

Bergstrom

[11] Patent Number: 4,873,861

[45] Date of Patent: Oct. 17, 1989

[54] LIFTING ARRANGEMENT IN VEHICLE CHASSIS STRAIGHTENING BENCHES

[75] Inventor: Hans R. Bergstrom, Kungsor, Sweden

[73] Assignee: Car-O-Liner Company, Wixom, Mich.

[21] Appl. No.: 212,874

[22] Filed: Jun. 29, 1988

[30] Foreign Application Priority Data

Jun. 30, 1987 [SE] Sweden ..... 8702701

[51] Int. Cl.[4] ..... B21D 01/12

[52] U.S. Cl. ..... 72/457; 72/705; 187/8.54

[58] Field of Search ..... 72/457, 705; 187/841, 187/843, 8.54, 8.61, 8.65; 254/2 B, 45

[56] References Cited

U.S. PATENT DOCUMENTS 2,552,974 5/1951 Johnson ..... 187/8.54

4,542,636 9/1985 Wright ..... 72/705

4,574,614 3/1986 Field ..... 72/705

4,585,198 4/1986 Chartier et al. ..... 72/705

*Primary Examiner*—Lowell A. Larson

*Attorney, Agent, or Firm*—Barnes, Kisselle, Raisch, Choate, Whittemore & Hulbert

[57] ABSTRACT

A lifting apparatus in a vehicle chassis straightening or aligning bench including a frame which can be raised and lowered and on which a vehicle chassis can rest. The lifting apparatus includes at least one post guide which can be removably secured to the frame and slidably receive a post therein. The lifting apparatus is positioned under the chassis such that lowering of the frame will result in the chassis bearing on upper end of the post and upon further lowering of the frame, displacement of the frame from the post so that a clamp device can be inserted between the chassis and the bench frame.

14 Claims, 3 Drawing Sheets

LIFTING ARRANGEMENT IN VEHICLE CHASSIS STRAIGHTENING BENCHES

FIELD OF THE INVENTION

This invention relates to vehicle chassis straightening or aligning benches, and more particularly to an apparatus for raising and lowering a vehicle chassis relative to an alignment bench.

BACKGROUND OF THE INVENTION

Subsequent to placing a damaged vehicle chassis on a chassis straightening or aligning bench, it is usually necessary to raise the chassis, or a part thereof, from the bench a distance sufficient to enable chassis clamps or like securing devices to be fitted to the bench and clamped to the chassis. Previously, this has been accomplished by using lifting jacks. These lifting jacks are unsatisfactory, in that they are expensive, difficult to align with the chassis, not easily adjusted, and unstable.

SUMMARY OF THE INVENTION

In accordance with this invention, a lifting apparatus for a vehicle chassis straightening or alignment bench has a post guide which can be secured to the bench and a post slidably received in the guide and when the bench has been partially raised, disposed under the vehicle chassis such that the post will support the chassis upon lowering of the bench.

Objects, features and advantages of this invention are to provide a lifting apparatus in vehicle chassis straightening benches which is capable of relatively lifting a chassis a distance sufficient to enable chassis clamps or like securing devices to be fitted to the bench and clamped to the chassis while firmly supporting the chassis a distance above the bench frame, relatively inexpensive, readily and easily set up and adjusted, stable, rugged, durable, and of relatively simple design and economic manufacture and assembly.

BRIEF DESCRIPTION OF THE DRAWINGS

These and other objects, features and advantages of this invention will be apparent from the following detailed description, appended claims and accompanying drawings, in which:

DETAILED DESCRIPTION

Figure 1:
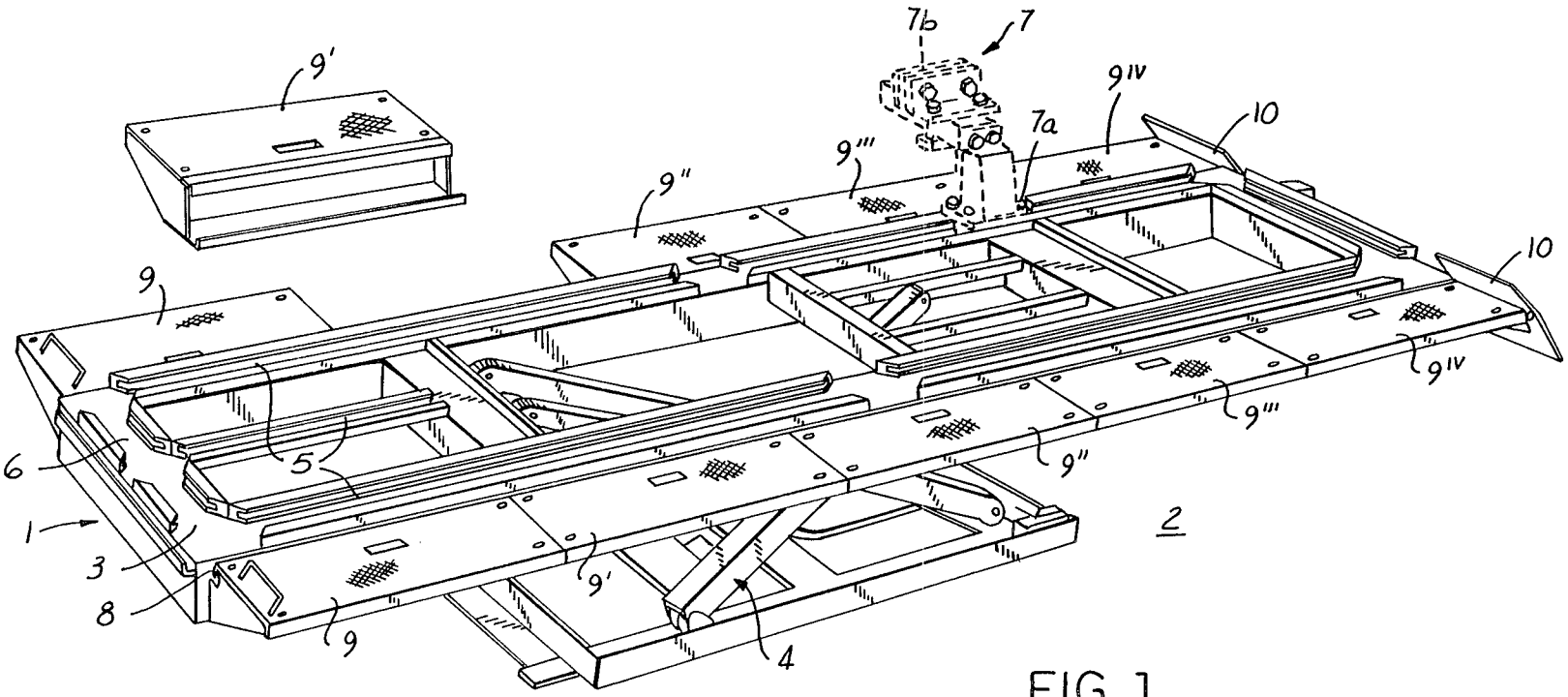
FIG. 1 is a perspective view of a chassis straightening or aligning bench capable of utilizing a lifting apparatus of this invention.

Referring in more detail to the drawings, FIG. 1 illustrates a straightening or aligning bench 1 which includes a rectangular, horizontal frame 3 of steel beams which can be positioned and oriented at a given distance above a base plane, such as a workshop floor 2. The frame has removably received or permanently fixed thereto support ramps 9 along the longitudinal side surfaces 3*a* so as to enable the wheels of a vehicle to rest on the horizontal support surface 9*a* of the ramps 9 in a desired position and at a desired location above the frame 3. Accordingly, the width of the frame may be more narrow than the distance between the wheels of respective wheel pairs of a damaged vehicle to be supported on the frame, or the flat frame structure may be constructed to have the same or greater width than that of the vehicle.

The frame 3 has on its upper surface, longitudinally and transversely extending guide grooves or channels 5 and 6 which are intended to accommodate a selected number of attachment devices, such as chassis clamps 7. Such chassis clamps or attachment devices are used to firmly secure the vehicle chassis in fixed relationship to the frame. The clamps 7 are secured firmly in one of the guide grooves or tracks 5 and 6 by a guide part 7*a*. The clamp is secured tightly against a selected chassis part, such as a chassis sill, by way of a clamping jaw 7*b*.

Figure 2:
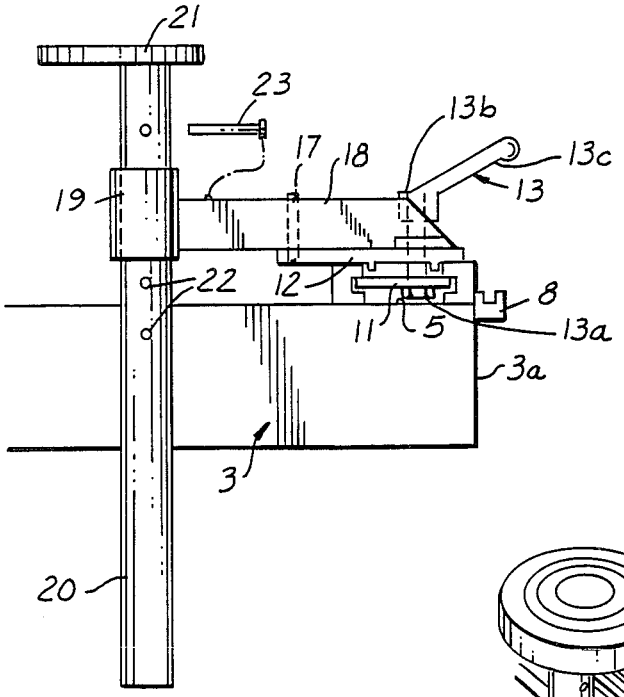
FIG. 2 is an enlarged fragmentary end view of a lifting apparatus embodying this invention, mounted on guide grooves or tracks of the bench of FIG. 1.
Figure 3:
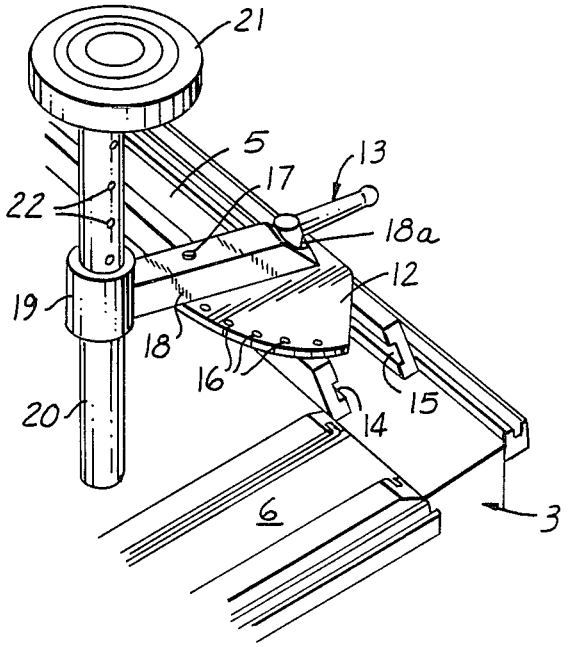
FIG. 3 is a perspective view of the lifting apparatus of FIG. 2.

As shown in FIGS. 2 and 3, a lifting apparatus of this invention can be mounted in the guide grooves or channels 5 and 6 on the frame 3 by way of a guide attachment. The guide attachment includes two horizontal plates 11 and 12 which are located one above the other and are held together by means of a clamping or tightening device 13. The clamping device has a threaded bolt 13*a* engaging a complimentary threaded head 13*b* of a handle 13*c*. The lower plate 11 can be fitted into one of the channels 5 or 6 and be received by the recesses 14 and 15 provided in the wall of the channels as illustrated in FIG. 2. The upper plate 12 abuts the defined surfaces of the outwardly facing openings of the channels 5. The upper plate has therein a plurality of holes 16 formed circumferentially therearound for releasably retaining an arm 18, which is journaled for rotation about the clamping device 13, and has an associated positioning pin 17 to be selectively received by one of the upper plate holes 16. The bolt 13*a* of the clamp device passes through a slot 18*a* in one end of the arm which underlies the threaded head 13*b* of the handle. The free end of the arm 18 carries a post guide in the form of a vertically extending cylindrical sleeve 19. A cylindrical post 20 is received in the cylindrical sleeve 19 and can be slidably moved in the direction of the post's longitudinal axis.

The post 20 has mounted on its upper end a horizontal, circular support plate 21 for lying supportively against or under a selective chassis part 26. The post 20 has a plurality of axially spaced apart transverse holes 22 for receiving a locking pin 23 to secure the post in relation to the guide sleeve 19 when desired.

Figure 4:
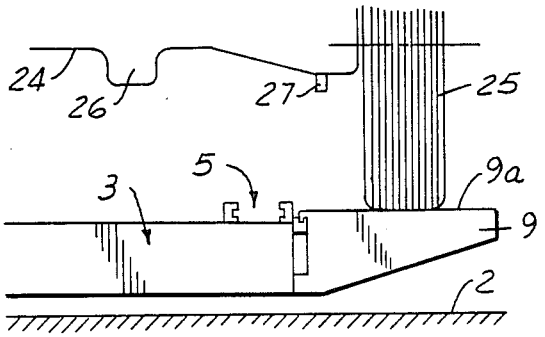
FIG. 4 is a semi-schematic fragmentary end view of the bench of FIG. 1 with a vehicle thereon.
Figure 5:
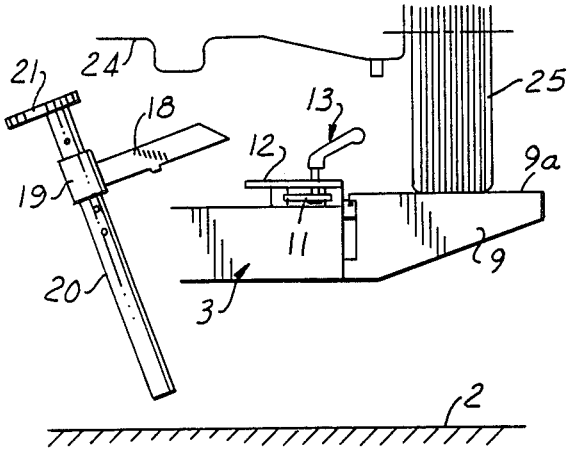
FIGS. 5–8 are semi-schematic fragmentary end views of the bench illustrating five different stages in mounting and using the lifting apparatus of this invention.
Figure 6:
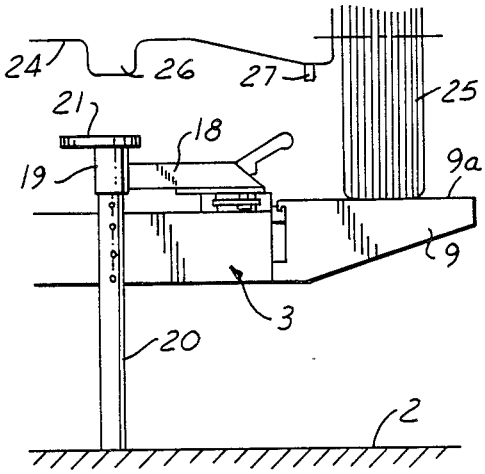

As shown in FIG. 4, in use the bench is fully lowered and a vehicle, such as an automobile, is rolled up onto the chassis support frame 3 of the bench with its wheels 25 resting on the drive ramps 9 of the frame 3. The frame 3 is then raised about 70 cm above the floor 2 by means of the scissor-like lifting device 4 of the bench to a predetermined position sufficient to allow attachment of the lifting apparatus and a chassis clamp 7 to the frame 3. As shown in FIG. 5, the guide attachment plates 11 and 12 are fitted to the guide groove 5. In assembled relationship, the post 20, guide 19 and arm 18 are then mounted on the plate 12 at a desired angular position, by inserting the associated positioning pin 17 into one of the holes formed in the guide plate 12. As shown in FIG. 6, the arm 18 is then tightened firmly against the upper plate 12 by means of the clamping or tightening device 13. As such, the post 20 is slidably received in the guide sleeve, and usually rests under its own weight against the floor 2 with the supportive plate 21 on its upper end bearing on or slightly spaced from the guide sleeve 19.

Figure 7:
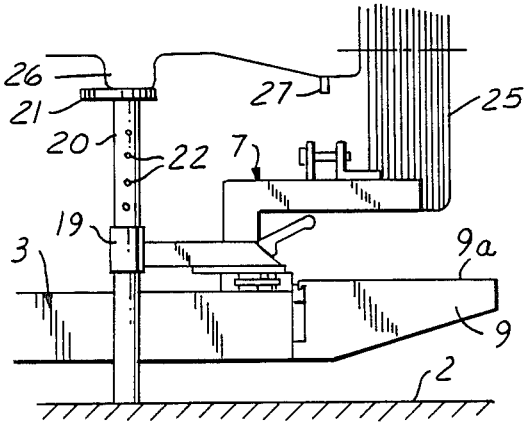

The frame 3 of the bench is then lowered, so that the post guide sleeve 19 slides along the post 20 and the support plate 21 abuts or bears on a surface 26 on the chassis. Upon further lowering of the frame 3, the post 20 holds the chassis in a constant position relative to the floor 2 and the vehicle wheels 25 disengage and become spaced from the frame ramps 9. In this position, as shown in FIG. 7, there is sufficient distance between the frame and the chassis to allow a chassis clamp 7 to then be fitted to the guide groove 5 at a suitable distance from the guide attachment plates 11 and 12 of the lifting apparatus. The frame 3 is then raised until the chassis clamp 7 engages a sill 27 of the chassis so that the clamp 7 can be tightened against the sill. If desired, the assembly comprising the post 20, post guide sleeve 19 and arm 18 can now be disconnected and removed from the bench.

Preferably, at least two lifting apparatus of this invention are fitted to the bench frame, such that either the front carriage or the rear carriage, or one side of the chassis can be lifted relative to the frame. When it is desired to lift the whole chassis relative to the frame, four lifting apparatus are preferably used, that is, one lifting apparatus adjacent each corner beneath the chassis. However, it is contemplated that a single lifting apparatus could be positioned centrally beneath the vehicle so as to lift solely the rear part or front part of the vehicle.

Figure 8:
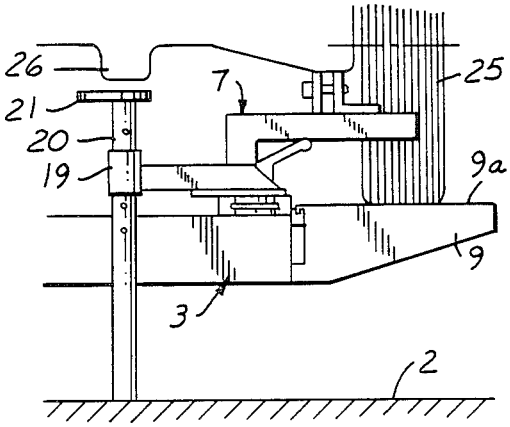

Alternatively, as illustrated in FIG. 8, if a locking pin 23 were inserted into a hole 22 of the post 20 located immediately afore the guide sleeve 19, the vehicle would be fixedly supported on the post 20, such that the vehicle will accompany the frame of the bench as it is lifted. In this instance, no chassis clamps 7 are required for securing the vehicle.

I claim:

1. A lifting apparatus for a vehicle chassis straightening bench having a horizontal chassis support frame with an elongate guide track carried by the frame and the frame being constructed and arranged to be raised and lowered above a base plane, which comprises: a guide attachment constructed to be removably receivable on and releasably securable to the guide track, a manually operable clamp carried by said guide attachment and constructed and arranged to releasably secure said guide attachment when on the track to the frame, an arm separate and removable from said guide attachment and constructed and arranged to be carried by, supported by and releasably secured to said guide attachment, a post guide secured to said arm and constructed and arranged to slidably receive a post, a post slidably received in said post guide and with its axis extending substantially vertically when said arm is received on said guide attachment when received on the guide track and secured to the frame, the upper end of the post constructed and arranged to support a part of a vehicle chassis, said straightening bench and lifting apparatus in assembled relationship beinc constructed and arranged such that lowering of the support frame from a raised position will result in displacement of the upper end of the post relative to the frame and said post having a length such that when the frame is lowered through a predetermined distance said post supports the chassis part and upon further lowering of the frame said chassis part will be displaced by said post relative to the frame.

2. The lifting apparatus of claim 1 wherein said post has therein a plurality of holes along its longitudinal length for receiving a locking pin so as to fix said post in relationship to said post guide.

3. The lifting apparatus of claim 1 wherein said post guide comprises a sleeve constructed and arranged to slidably receive said post, said arm is constructed and arranged to be journaled for rotation about a vertical axis, and means for locking said arm in a desired angular position of rotation on said guide attachment.

4. The lifting apparatus of claim 1 wherein the track has at least one recess therein and said clamp comprises, a first member removably receivable in the recess and a second member operably connected with said first member, carried by said guide attachment, and constructed and arranged to urge said first member and guide attachment toward each other to releasably secure said guide attachment on said track.

5. The lifting apparatus of claim 4 wherein said arm is also constructed and arranged to be operably associated with said clamp when said arm is received on said guide attachment and said clamp is constructed and arranged to also releasably secure said arm to said attachment when securing said attachment to said track.

6. The lifting apparatus of claim 5 wherein said arm when received on said guide attachment pivots about said second member of said clamp, when said clamp is released.

7. The lifting apparatus of claim 4 wherein said arm when received on said guide attachment pivots about said second member of said clamp when said clamp is released.

8. The lifting apparatus of claim 7 which also comprises releasable retainer means for releasably retaining said arm in a predetermined angular position on said guide attachment.

9. A lifting apparatus for a vehicle chassis bench having a generally horizontal chassis support frame constructed and arranged to be raised and lowered generally vertically relative to a base plane and a generally horizontally extending elongate track carried by the frame which comprises: a guide attachment constructed and arranged to be removably receivable on and releasably securable to the track, a separate arm constructed and arranged to be removably receivable on and releasably securable to said guide attachment, a post guide carried by said arm and constructed and arranged to slidably receive a post, an elongate post slidably received in said post guide with its axis extending substantially vertically when said arm is secured on said guide attachment and said guide attachment is secured on the track and with the upper end of the post being constructed and arranged to underlie and support at least a portion of a vehicle chassis, a clamp carried by said guide attachment and constructed and arranged to releasably and simultaneously secure both said arm to said guide attachment and said guide attachment on the track, and said guide post being of sufficient length so that when the straightening bench and lifting apparatus are in assembled relationship lowering of the support frame from a raised position will result in displacemnt of the upper end of the post relative to the frame so that the post supports a portion of the chassis of the vehicle received on the straightening bench and upon further lowering of the frame at least such portion of the chassis will be displaced relative to the frame.

10. The lifting apparatus of claim 9 wherein said clamp comprises, a bolt member having a threaded portion and a head member have complimentary threads mating with those of said bolt member, and said arm has a portion constructed and arranged when in assembly with said clamp to underlie said head member with said bolt member passing through said portion of said arm.

11. The lifting apparatus of claim 9 which also comprises said arm being constructed and arranged to engage and pivot about said clamp when released relative to said guide attachement on an axis generally parallel to the axis of the elongate post when slidably received in said post guide.

12. The lifting apppartus of claim 11 wherein said clamp comprises, a bolt member having a threaded portion and a head member have complimentary threads mating with those of said bolt member and said arm has a portion constructed and arranged when in assembly with said clamp to underlie said head member with said bolt member passing through said portion of said arm.

13. The apparatus of claim 12 wherein said portion of said arm has a slot therethrough and when in assembly said bolt member and said portion of said arm when the clamp is released journal said arm for such pivotal movement of said arm relative to said guide attachment.

14. The lifting apparatus of claim 13 wherein said clamp also comprises a plate operably connected to said bolt member and constructed and arranged when in assembly to be received in at least one recess in the guide track of the frame.

* * * * *